US005971369A

United States Patent [19]

Neveu et al.

[11] Patent Number: 5,971,369

[45] Date of Patent: Oct. 26, 1999

[54] COMBINATION HUMIDIFIER AND VAPORIZER

[75] Inventors: Steve Neveu, Hattiesburg, Miss.; Marlin L. Goodnight, Fargo, N. Dak.

[73] Assignee: Sunbeam Products, Inc., Boca Raton, Fla.

[21] Appl. No.: 09/004,930

[22] Filed: Jan. 9, 1998

[51] Int. Cl.[6] ..... B01F 3/04

[52] U.S. Cl. ..... 261/91; 261/119.1; 261/142; 261/DIG. 65

[58] Field of Search ..... 261/91, 119.1, 261/142, DIG. 29, DIG. 65

[56] References Cited

U.S. PATENT DOCUMENTS

| | | | |
|---|---|---|---|
| 3,512,806 | 5/1970 | Romney et al. | 261/DIG. 65 |
| 3,971,913 | 7/1976 | Myklebust . | |
| 4,012,472 | 3/1977 | Lindsey | 261/DIG. 65 |
| 4,039,639 | 8/1977 | Kankel et al. | 261/DIG. 65 |
| 4,100,235 | 7/1978 | Thornwald | 261/DIG. 65 |
| 4,203,027 | 5/1980 | O'Hare et al. | 261/142 |
| 4,810,854 | 3/1989 | Jursich . | |
| 5,259,062 | 11/1993 | Pelonis | 261/DIG. 65 |
| 5,607,627 | 3/1997 | Berkeley et al. . | |
| 5,611,967 | 3/1997 | Jane et al. | 261/142 |
| 5,693,270 | 12/1997 | Moore et al. . | |
| 5,805,768 | 9/1998 | Schwartz et al. | 261/DIG. 65 |

*Primary Examiner*—C. Scott Bushey

*Attorney, Agent, or Firm*—Kramer, Levin, Naftalis & Frankel LLP

[57] ABSTRACT

A combination vaporize/humidifier having a bucket member for holding water, a vaporizer head and a humidifier head wherein either connectors are provided on the humidifier head and vaporizer head to directly connect the heads to the bucket member. An alternative embodiment provides for an adapter plate such that the adapter plate allows for the heads to be securely attached to the bucket member.

7 Claims, 3 Drawing Sheets

COMBINATION HUMIDIFIER AND VAPORIZER

BACKGROUND OF THE INVENTION

1. Field of the Invention

This invention relates to a device for providing moisture to the atmosphere that can be used as both a humidifier and a vaporizer. More particularly, the present invention concerns a device for providing moisture in the air substantially comprising a bucket member defining a reservoir and an opening, a humidifier head and a vaporizer head wherein the device can function as a humidifier or a vaporizer by interchanging the heads. The present invention further provides an adapter plate that allows for either the humidifier head or the vaporizer head to be securely fastened to the bucket member.

2. Description of the Related Art

The use of vaporizers and humidifiers are well known. Examples of a vaporizer and a humidifier are disclosed in U.S. Pat. No. 5,693,270 and U.S. Pat. No. 5,607,627, respectively. Vaporizers are commonly used when one desires to introduce moisture in the form of steam into the atmosphere to break-up congestion in the user's lungs or nasal passages. Also, medication is sometimes placed on the vaporizer head so that the medication can be transported by the steam to the user's respiratory system. Humidifiers are commonly used when one desires to introduce moisture in the form of a cool mist into the atmosphere to eliminate dry air soothing a sore throat or cough. In general, humidifiers are used when it is desired to only counteract dryness in the air. Whereas, vaporizers, although also used to add moisture to the atmosphere and counteract dryness in the air, are used to break-up congestion in the user's lungs or nasal passages. Because humidifiers and vaporizers are used for different purposes, a household may need to purchase both a humidifier and a vaporizer.

Nowhere in the related art is there disclosed or suggested a device which has the capacity to function as a humidifier and as a vaporizer. Therefore, there is a definite need for the present invention which performs the functions of both a humidifier and a vaporizer and eliminates the need and expense of purchasing both a vaporizer and a humidifier.

SUMMARY OF THE INVENTION

Accordingly, the present preferred invention provides a single device which has the capacity to function as a humidifier and a vaporizer by interchanging the humidifier head and vaporizer head which substantially comprises a bucket member defining a reservoir and an opening, a humidifier head, and a vaporizer head wherein the humidifier head and the vaporizer head are received by the bucket member opening.

The present invention further provides an adapter plate which adapts the opening of the bucket member that is sized and proportioned to securely receive only one of the vaporizer head and the humidifier head and adapts it to receive the other of the vaporizer head and the humidifier head. The adapter plate has connectors which provide for the easy assembly and fastening of the adapter plate to the bucket member. Preferably, the connectors take the form of spring lock fingers having a U-shaped cross-section and being positioned on one side of the adapter plate and tab members being positioned on the opposing side of the adapter plate; however, many other types of connectors can be used. The embodiment of the present preferred invention further provides a bayonet connection between the adapter plate and vaporizer head; however other connections can be utilized.

The present preferred invention further provides an alternative embodiment wherein the vaporizer head and the humidifier head are sized and proportioned such that both heads are securely received by the bucket member opening and securely attached to the bucket member. In one preferred embodiment, the adapter plate is eliminated by providing connectors on the housing of the vaporizer head which engages the bucket member thereby fastening the vaporizer head to the bucket member. Preferably, the connectors take the form of a flexible spring finger, but other connectors can be used. And the humidifier head is provided with connectors which are preferably U-shaped spring fingers and which securely attach the humidifier head to the bucket member.

Other details, objects and advantages of the present preferred invention will become more apparent with the following description of the present preferred embodiments.

BRIEF DESCRIPTION OF THE DRAWINGS

The accompanying drawings describe the present preferred invention in which.

DETAILED DESCRIPTION OF THE PREFERRED EMBODIMENTS

Although this invention is suitable for other uses it will be described as being used in a device for adding moisture to the atmosphere, specifically, a combination humidifier/vaporizer.

Figure 1:
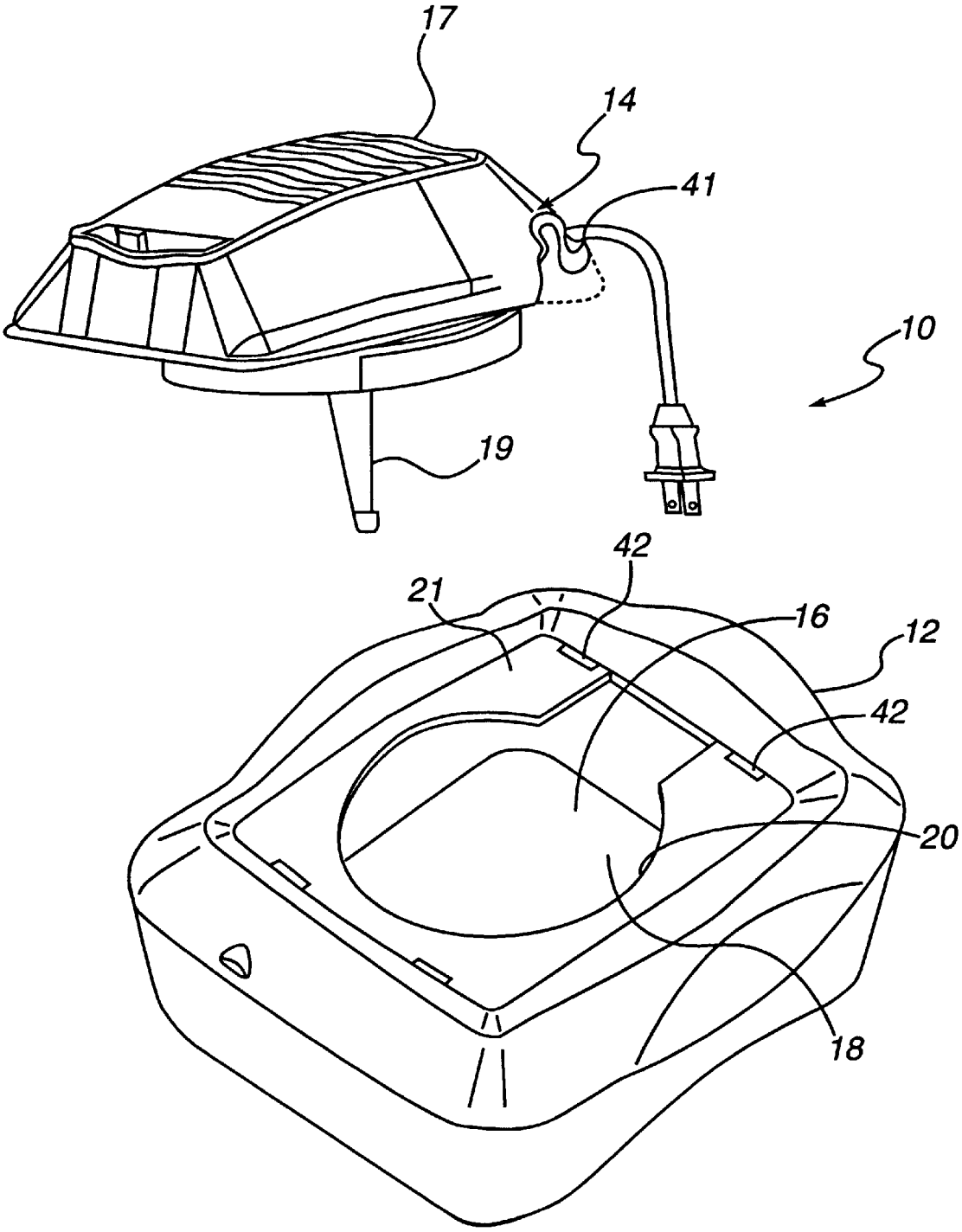
FIG. 1 is an exploded view of a combination vaporizer/humidifier of the present preferred invention employing a humidifier head.

FIG. 1 illustrates the humidifier configuration of the combination vaporizer/humidifier 10 of the present preferred invention substantially comprising a bucket member 12, and a humidifier head 14. This configuration is employed when the user desires for the combination vaporizer/humidifier 10 to function as a humidifier and release a cool mist into the environment. The humidifier head 14 preferably is of the type disclosed in U.S. Pat. No. 5,607,627 but other types of humidifier heads can be used. The humidifier head 14 preferably has a vented top housing 17, a fan (not shown) for producing the flow of air in the top vented housing 17, a motor (not shown) also positioned within the top vented housing 17 and an impeller assembly 19.

The bucket member 12 defines a reservoir 16 and an opening 18. A more detailed description of the bucket member 12 will follow when describing FIG. 2. The edge 20 of the opening 18 forms a cross-section that is sized and proportioned such that the impeller assembly portion 19 of the humidifier head 14 is received therein and the humidifier head 14 is securely connected to the bucket member 12 by a snap fit method wherein two rear U-shaped finger members 41 (one of which is not shown) are provided on the top vented housing 17 which engage apertures 42 of the bucket member 12 such that the humidifier head 14 is pivoted about the finger members 41 to a horizontal upright position.

Figure 2:
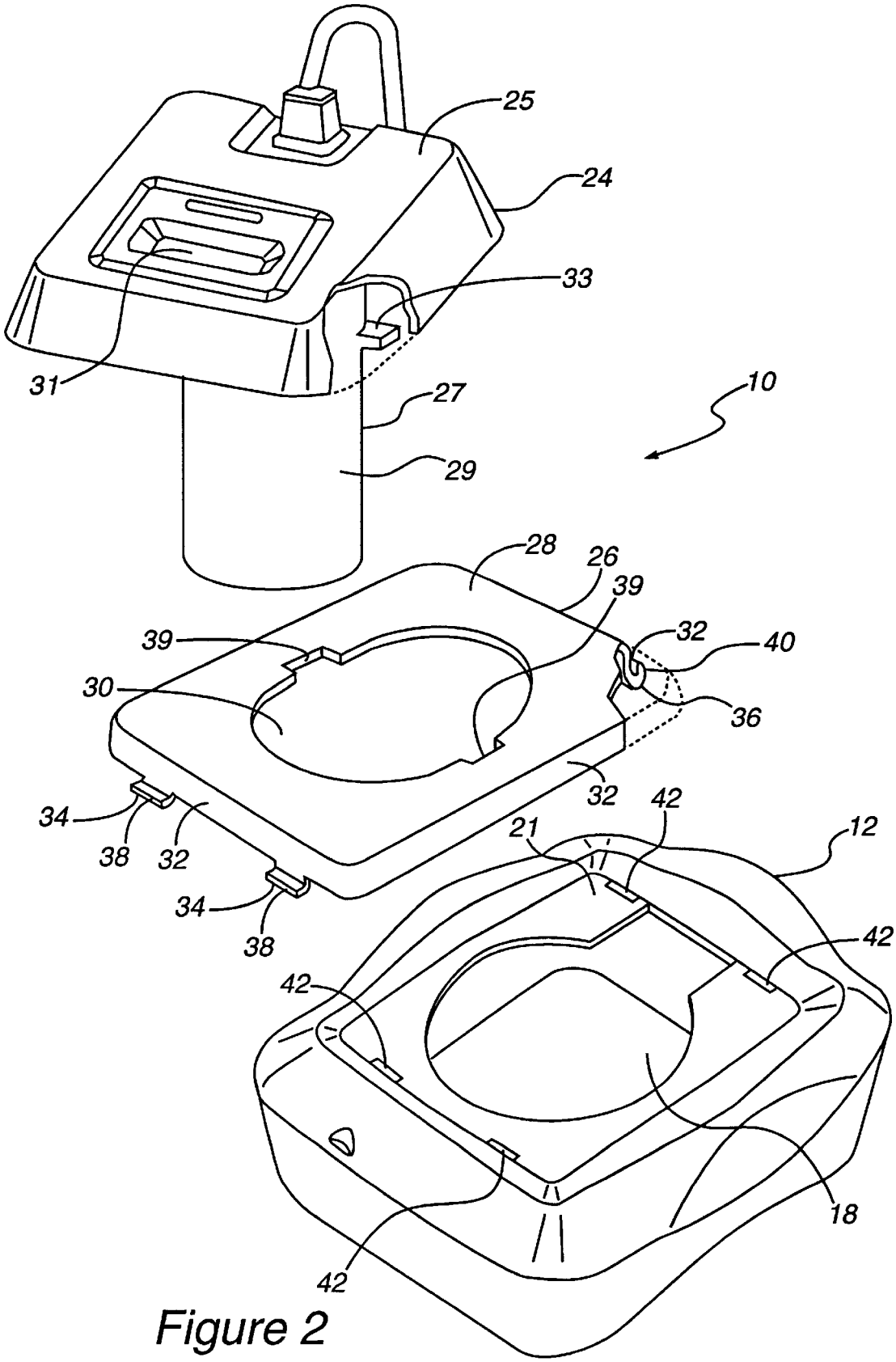
FIG. 2 is an exploded view of the combination vaporizer/humidifier of the present preferred invention employing a vaporizer head and an adapter plate and the bucket member shown in FIG. 1.

Referring to FIG. 2, the combination vaporizer/humidifier 10 is shown employing the vaporizer head 24 which provides for the release of steam into the environment. The vaporizer configuration of the combination vaporizer/humidifier 10 has the bucket member 12 as shown in FIG. 1, a vaporizer head 24, and an adapter plate 26. The adapter plate 26 functions to securely attach the vaporizer head 24 to the bucket member 12 wherein the vaporizer head 24 is not sized and proportioned to be directly securely attached to the bucket member 12.

The adapter plate 26 has a planar surface 28 defining an opening 30 through which the vaporizer head 24 extends and side members 32. The planar surface 28 further defines key ways 39. First connectors 34 are positioned on one side member 32 of the adapter plate 26 and second connectors 36 are positioned on an opposing side member 32 of the adapter plate 26. Although not shown, there are two second connectors 36 positioned along the side member 32. The first connectors 34 are preferably tab members 38 and the second connectors 36 are preferably spring fingers 40 which have a U-shaped configuration.

The vaporizer head 24 preferably has a cover member 25 and a heating unit assembly 27 wherein the heating unit assembly 27 has a pair of electrodes (not shown) positioned within a housing 29 and the cover member 25 has a hole 31 through which vapors can be emitted from the vaporizer into the environment. The vaporizer head 24 also has two tab members 33 (one of which is not shown) extending therefrom. The tab members 33 are positioned diametrically opposite of one another on the housing 29. Preferably, the vaporizer will perform substantially as described in U.S. Pat. No. 5,693,270. However, although not illustrated, the vaporizer head can take a variety of forms and include a variety of features.

The bucket member 12 has apertures 42 which receive the first and second connectors 34 and 36 and which are positioned along opposite ends of the bucket member 12. Although the first and second connectors 34 and 36, as illustrated, are the preferred configurations, various other types of connectors can be used.

In order to assemble the combination vaporizer/humidifier 10 having the vaporizer head 24, the adapter plate 26 securely attaches to the bucket member 12 by first placing the tab members 38 into the apertures 42 and then pivoting the adapter plate 26 such that the spring fingers 40 engage the apertures 42 positioned at the other end of the bucket member 12. Once the adapter plate 26 is in position and the opening 30 of the adapter plate 26 and the opening 18 of the bucket member 12 are substantially aligned, the heating unit assembly 27 of the vaporizer head 24 is inserted through the adapter plate opening 30 and the bucket member opening 18 such that it extends into the reservoir of the bucket member 12. When inserting the vaporizer head 24 within the bucket member 12, the tab members 33 (one of which is not shown) are aligned with the key ways 39 and then the vaporizer head 24 is rotated to lock it in position forming a bayonet connection and preventing the vaporizer head 24 from being directly pulled out of the bucket member 12. Although not illustrated, other types of connections can be used in place of the tab members 33 and key way 39 connection.

Although not disclosed, the adapter plate can be sized and proportioned to be used with the humidifier head when the humidifier head is not configured to be securely attached to the bucket member. In other words, in the instance where the vaporizer head and bucket member are configured to be securely attached to one another without the use of an adapter plate, an adapter plate can be used to allow for the humidifier head to be securely attached to the bucket member and eliminate the need for a second bucket member.

Figure 3:
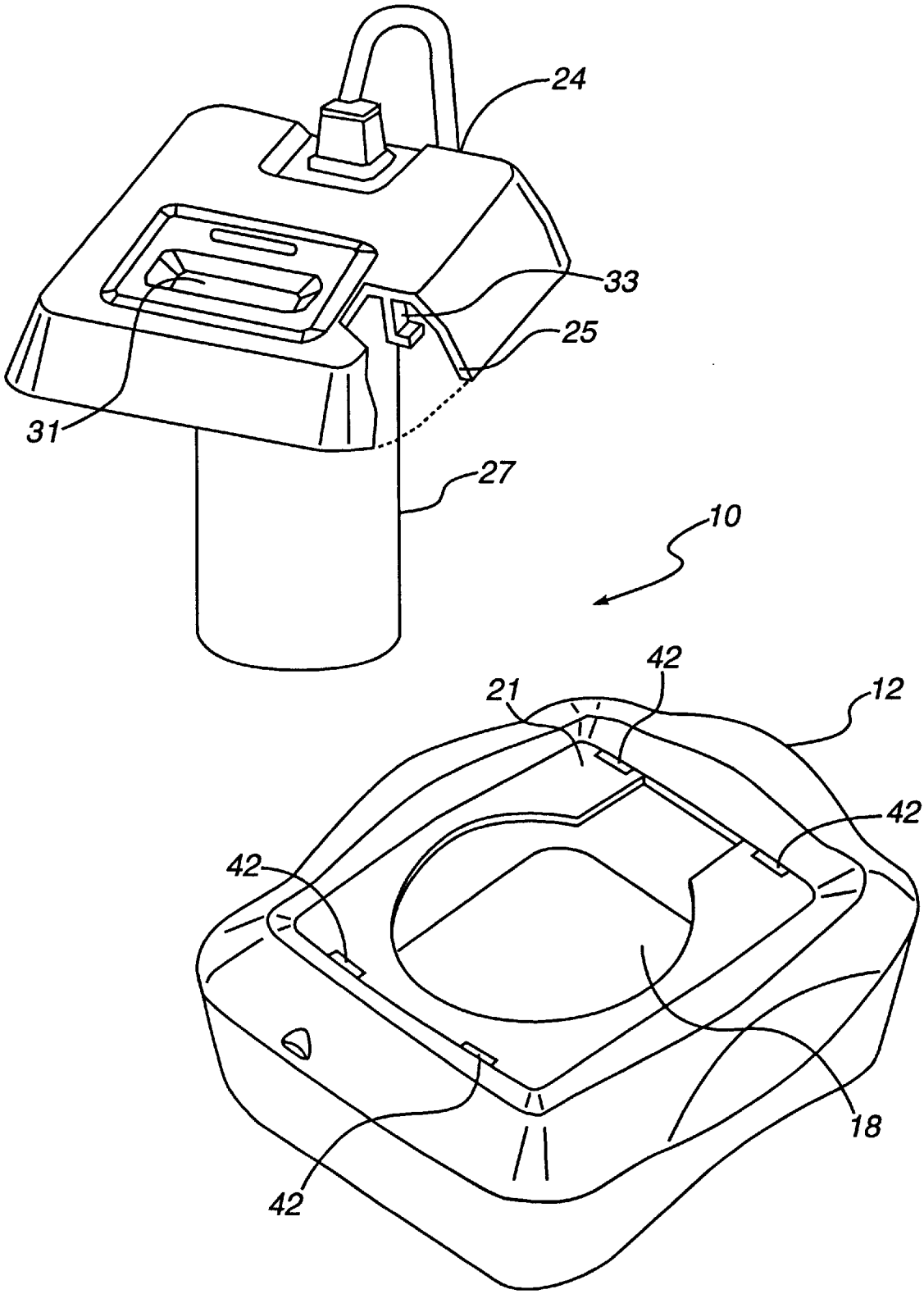
FIG. 3 is an exploded view of an alternative embodiment of the combination vaporizer/humidifier of the present preferred invention employing a vaporizer head that is directly attached to the bucket member shown in FIG. 1.

FIG. 3 illustrates an alternative embodiment of the combination vaporizer/humidifier of the present invention wherein the combination vaporizer/humidifier 10 substantially comprises the bucket member 12 shown in FIG. 1 and the humidifier head 14 also shown in FIG. 1 and the vaporizer head 24 shown in FIG. 3. The vaporizer head 24 has a cover member 25 with a hole 31 through which vapors are emitted into the atmosphere, and a heating unit assembly 27 similar to that shown in FIG. 2. The cover member 25 is similar to that shown in FIG. 2 except that the two tab members 33 are replaced with L-shaped spring members 35 (one of which is not shown). L-shaped spring members 35 are positioned diametrically opposite to one another on the diameter of the heat unit assembly 27.

In order to assemble the combination vaporizer/humidifier 10 shown in FIG. 3, the heating unit assembly 27 is received within the opening 18 of the bucket member 12 and the spring members 35 are flexed to fit within the bucket member opening 18 and engage the underside of surface 21.

The bucket member, the adapter plate and the cover members and housings are preferably made from a plastic material.

While the present preferred invention has been described herein, it is distinctly understood that the invention is not limited thereto but may be otherwise variously embodied in the scope of the following claims and any equivalents thereof.

We claim:

1. An apparatus for providing moisture in the air comprising:

(a) a humidifier head;

(b) a vaporizer head;

(c) a bucket member defining a reservoir and an opening sized to receive one of the humidifier head or the vaporizer head; and (d) an adapter plate comprising an opening sized to receive the other of the humidifier head or the vaporizer head into an operable position extending within the bucket member for providing moisture to the air and at least one first connector for releasably securing the adapter plate to the bucket member, wherein when the adapter plate is secured to the bucket member the said other of the humidifier head or the vaporizer head may be secured thereto in said operable position and when the adapter plate is not secured to the bucket member, said one of said humidifier head or the vaporizer head may be secured directly to and extend into the opening of the bucket member in an operable position for providing moisture to the air.

2. The apparatus of claim 1, wherein the adapter plate further comprises tab members used to align the opening of the adapter plate with the opening of the bucket member such that the tab members engage apertures in the bucket member and allow for the adapter plate to pivot about the tab members.

3. The apparatus of claim 2, further comprising second connectors on the adapter plate which engage second apertures of the bucket member.

4. The apparatus of claim 3 wherein the vaporizer head has tab members and the adapter plate has key ways, and the vaporizer head tab members engage the adapter plate key ways.

5. The apparatus of claim 3 wherein the second connectors comprise at least one spring finger.

6. The apparatus of claim 1 wherein the vaporizer head has a cover member with spring fingers which engage the underside of a surface of the bucket member such that the vaporizer head is directly attached to the bucket member.

7. The apparatus of claim 1 wherein the at least one first connector is a tab member and the adapter plate further comprises at least one U-shaped spring finger which is sized and proportioned to engage apertures of the bucket member.

* * * * *